US006089239A

United States Patent [19]

Ehlhardt et al.

[11] Patent Number: 6,089,239

[45] Date of Patent: Jul. 18, 2000

[54] HAIR DRYER/STYLER

[75] Inventors: Huub Ehlhardt; Fokke R. Voorhorst, both of Drachten, Netherlands

[73] Assignee: U.S. Philips Corporation, New York, N.Y.

[21] Appl. No.: 09/359,875

[22] Filed: Jul. 27, 1999

[51] Int. Cl.[7] ..... A45D 20/12

[52] U.S. Cl. ..... 132/271; 34/97

[58] Field of Search ..... 132/271, 272; 34/96, 97, 98

[56] References Cited

U.S. PATENT DOCUMENTS 5,546,674 8/1996 Lange et al. ..... 34/97

5,894,849 4/1999 Ehlhardt et al. ..... 132/271

5,953,829 9/1999 Van Den Brug et al. ..... 34/97

FOREIGN PATENT DOCUMENTS

0473822A1 3/1992 European Pat. Off. .

*Primary Examiner*—Todd E. Manahan

*Attorney, Agent, or Firm*—Ernestine C. Bartlett

[57] ABSTRACT

The invention relates to a hair dryer/styler having a diffuser with elongated fingers. In order to obtain a comfortable contact between the fingers and the scalp and a better individual adaptation of the fingers to the scalp during use of the hair dryer/styler, the fingers are arranged, individually or in a number of small groups, on resilient means. Preferably, each finger is arranged on one resilient arm.

10 Claims, 5 Drawing Sheets

HAIR DRYER/STYLER

BACKGROUND OF THE INVENTION

The invention relates to a hair dryer/styler having a housing which accommodates a motor-fan unit for generating an air stream and having a diffuser for diffusing the emergent air stream and for reducing the velocity of the emergent air stream, which diffuser comprises a plurality of resilient fingers, which extend substantially in the direction of the emergent air stream and which can engage against a scalp during use of the hair dryer/styler.

Such a hair dryer/styler is known from EP-A-0 473 822. During use of a hair dryer/styler hairs can be picked up by the fingers of the diffuser for the purpose of styling the hair. The fingers then serve as hair styling elements. Furthermore, during use the diffuser should be kept at some distance from the head. In order to do this in a more controlled manner and make this more convenient for the user a diffuser is provided with such fingers. The air can then be blown into the hair in a more controlled manner, thus enabling the hair to be styled in a better way. A problem during use is that when the diffuser is positioned with respect to the head or when the hair is being styled the user is likely to bring the fingers of the diffuser into contact with the scalp. This is an uncomfortable sensation. In EP-A-0 473 822 it has been attempted to solve this by arranging all the fingers on one carrier plate. This carrier plate is resiliently depressible and is slightly pivotable inside the diffuser. The resilient carrier plate has a covering function and precludes damage in the case of an excessive pressure of the fingers on the scalp. Since all the fingers are carried by one carrier plate this does not provide an optimum protection against excessive pressure on the scalp.

SUMMARY OF THE INVENTION

It is an object of the invention to improve the hair dryer/styler of the type defined in the opening paragraph so as to obtain an optimum and comfortable contact of the fingers with the scalp during use of the hair dryer/styler.

To this end, the hair dryer/styler is characterized in that the fingers are carried, individually or in a number of small groups, by a plurality of resilient means, which are secured to the diffuser. Thus, the fingers are resiliently supported individually or in small groups, so as to enable a better adaptation to the shape of the scalp. Since there are more contact points the force per contact point is substantially lower. Moreover, the resilient mounting of the fingers is transmitted to the scalp smoothly instead of abruptly. In a preferred embodiment, the fingers are carried by a plurality of resilient arms. This enables a better adaptation of the fingers to the shape of the scalp.

In a preferred embodiment the fingers extend through openings in a wall portion of the diffuser. These openings are provided with a sealing diaphragm around the fingers in such a manner that no hairs can be caught in a gap between an edge of the opening and the finger and no air can leak through the gap and thereby disturb the controlled air stream. The sealing diaphragm readily allows movement of the fingers in the direction of the emergent air.

During use of the hair dryer/styler the fingers will move constantly to and from. In order to avoid that the arms carrying the fingers make contact with the wall portion of the diffuser and thus constantly produce a clicking sound, sound-damping means are interposed between the wall portion of the diffuser and the resilient arms. Said means may, for example, take the form of small pads.

Further embodiments of the invention include one or more of the following features:

(1) the fingers are carried by a plurality of resilient arms, which are secured to the diffuser; and/or (2) a wall portion of the diffuser has openings through which the fingers extend; and/or (3) the openings are provided with a sealing diaphragm around the fingers; and/or (4) the fingers are each arranged on a separate resilient arm; and/or (5) the resilient arms are arranged on a common central disc of the diffuser; and/or (6) the resilient arms extend substantially radially outward and have different lengths, the fingers being disposed at the ends of the arms; and/or (7) the resilient arms are carried by a common ring of the diffuser and each extend substantially radially inward; and/or (8) each resilient arm has a flexible U-shaped hinge; and/or (9) sound-damping means are interposed between the wall portion of the diffuser and the resilient arms; and/or

(10) the fingers are each individually arranged on a separate compression spring.

BRIEF DESCRIPTION OF THE DRAWINGS

The invention will now be described in more detail with reference to an example shown in drawings. In the drawings

DESCRIPTION OF THE PREFERRED EMBODIMENTS

Figure 1:
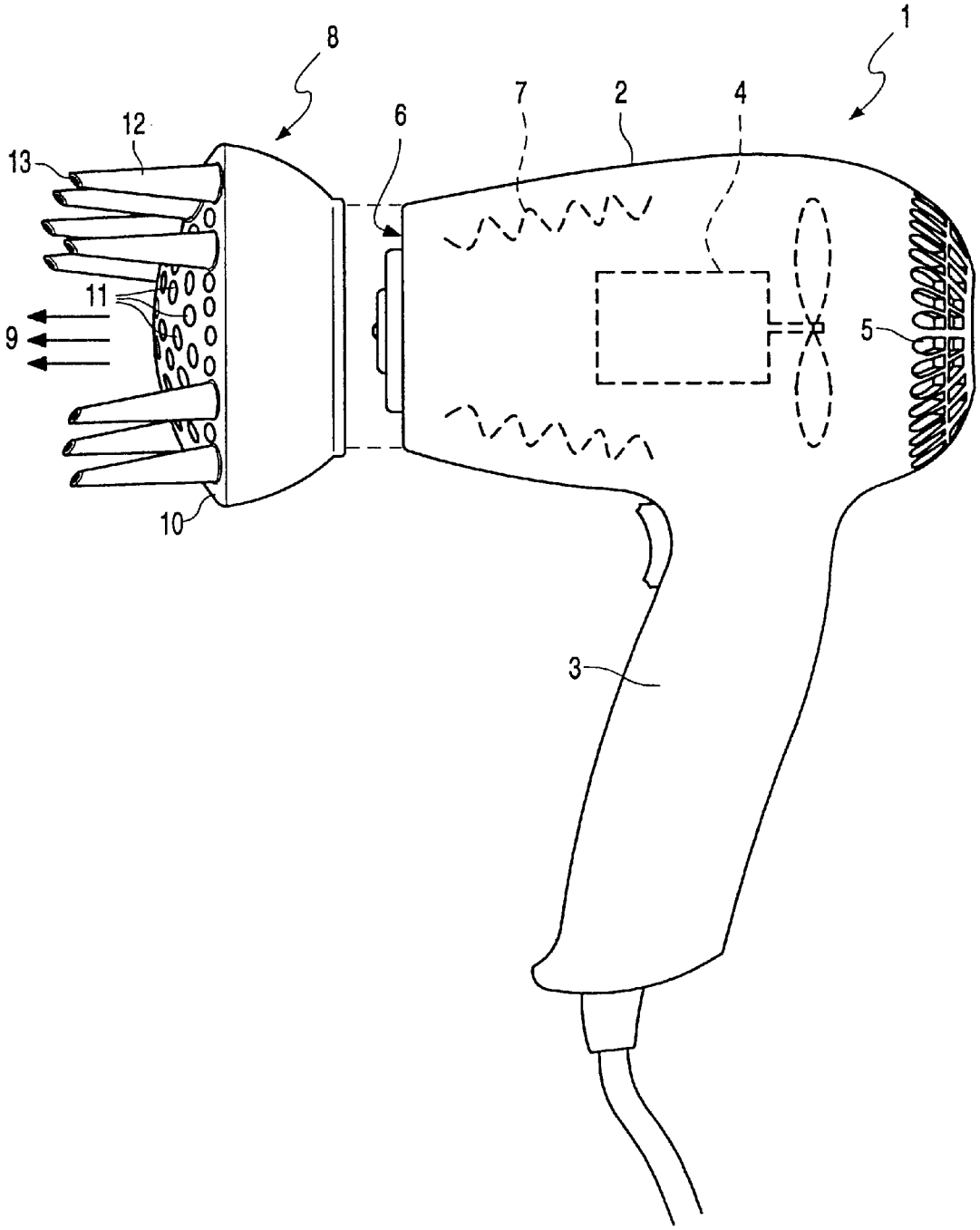
FIG. 1 shows a view of a hair dryer/styler.
Figure 2:
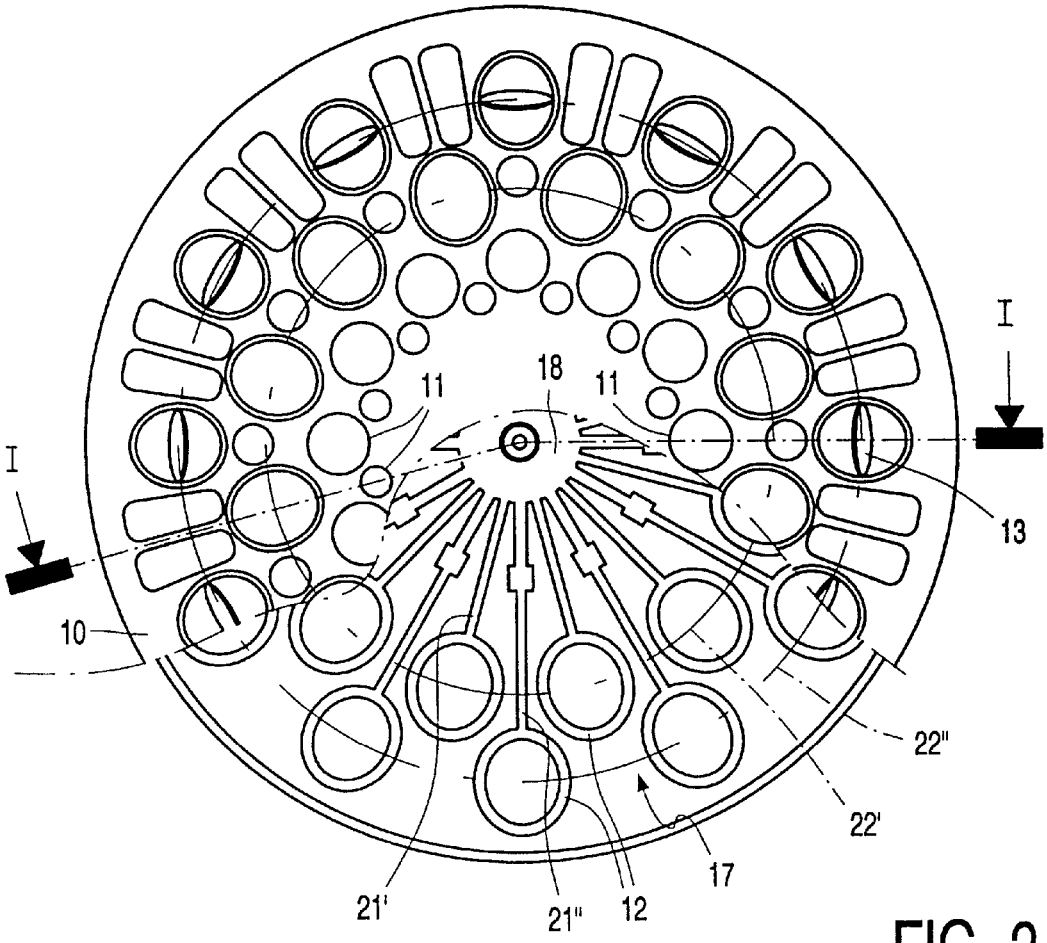
FIG. 2 is a front view of the diffuser, a wall portion being partly cut away.
Figure 3:
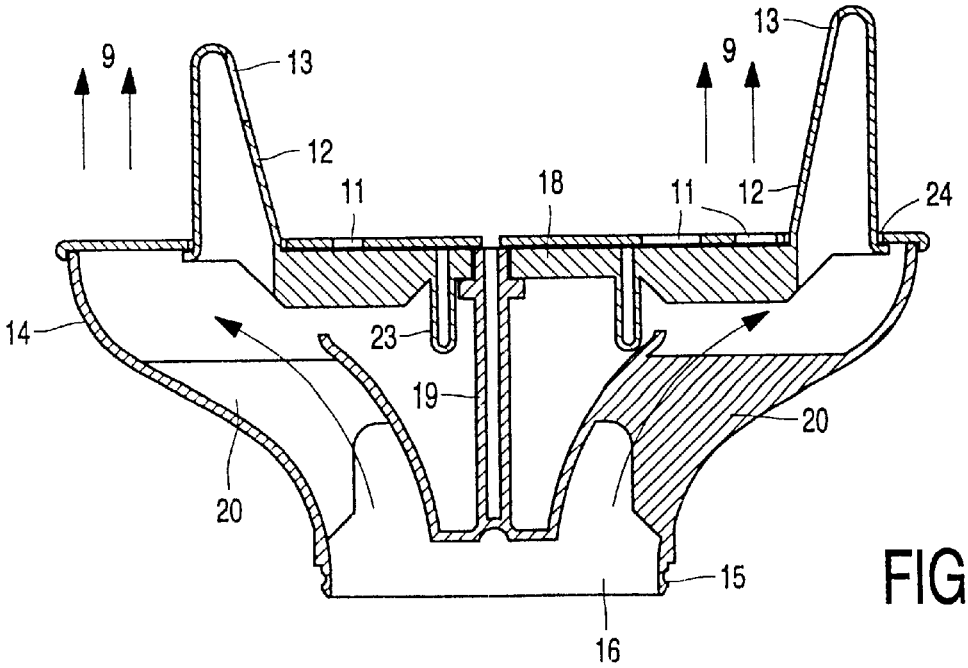
FIG. 3 is a cross-sectional view of the diffuser, taken on the line A—A.
Figure 4:
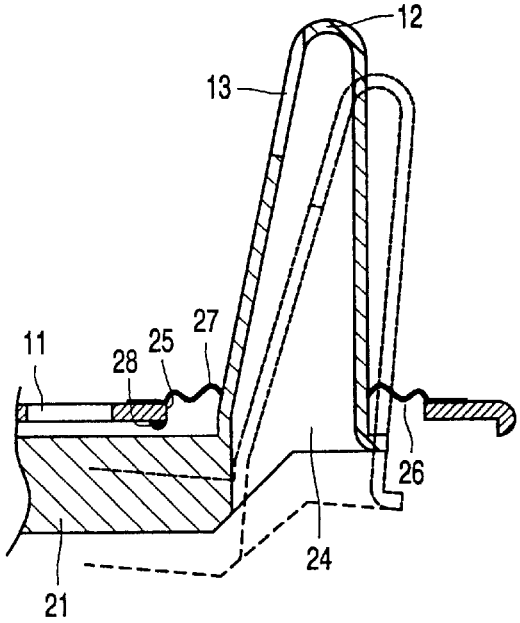
FIG. 4 shows a detail of the cross-sectional view of FIG. 3, and FIGS. 5–9 are a front view of a number of diffusers, showing different versions of resilient arms with fingers.
Figure 5:
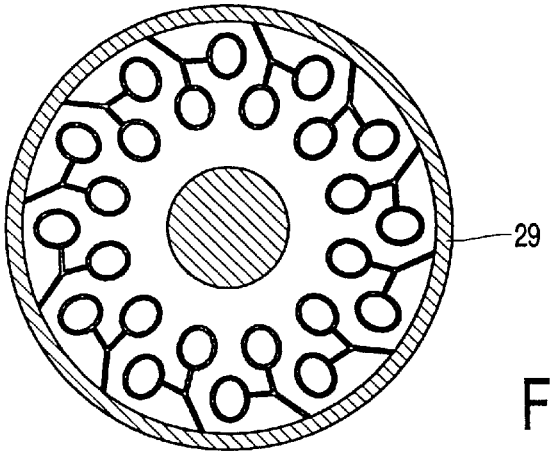
Figure 6:
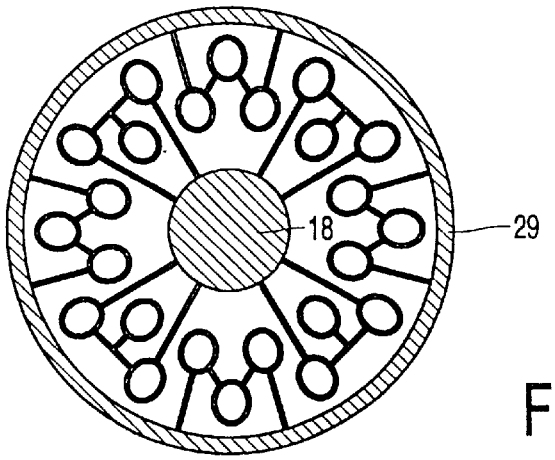
Figure 7:
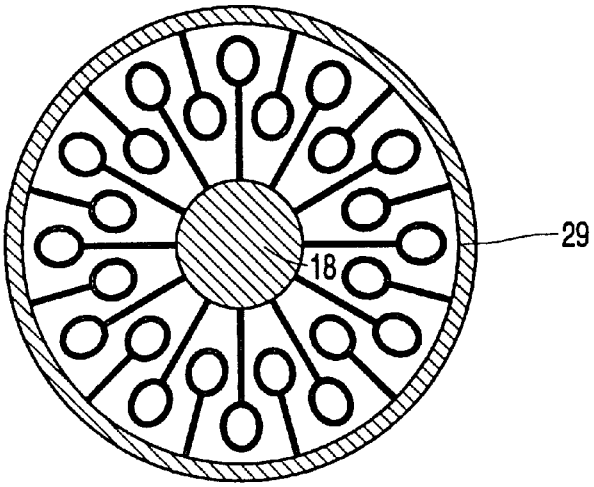
Figure 8:
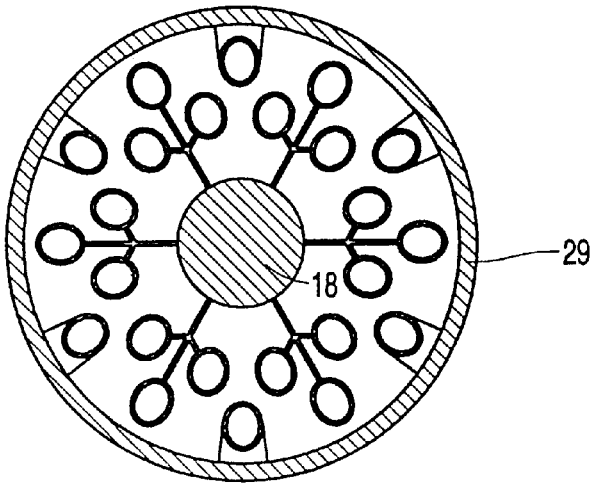
Figure 9:
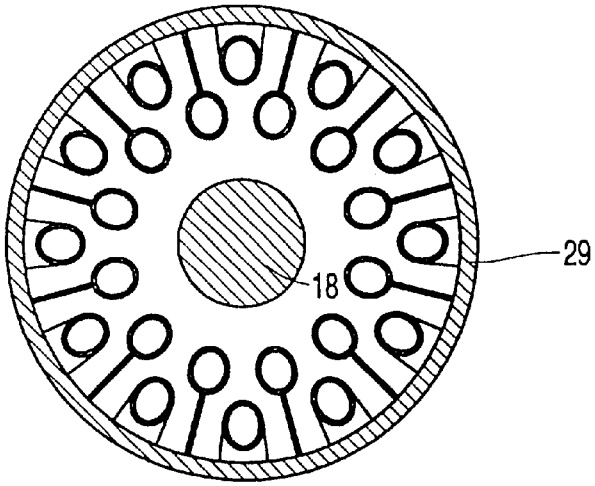

The hair dryer/styler shown in FIG. 1 comprises a housing 1, which basically consists of a cylindrical part 2, and a handle 3. The cylindrical part 2 accommodates a motor-fan unit 4 for the intake of air via inlet openings 5 at the rear of the cylindrical part 2 and for discharging the air via outlet openings 6 at the front of the part 2. The cylindrical part further accommodates a heating element 7 which can be turned on and turned off at option for heating or not heating the air which flows through. A diffuser 8 can be attached to the front of the cylindrical part 2 near the outlet openings 6. The diffuser has a conical shape and serves to diffuse the discharged air stream (9) and to reduce the velocity of the air stream so as to preclude the hair from being blown up too much. The front of the diffuser has a wall portion 10 formed with a plurality of air discharge openings 11. The diffuser further has a plurality of fingers 12. These fingers serve to raise hairs so as to enable it to be styled and also to keep the diffuser at a certain distance from the scalp so as to enable the air to be blown into the hair in a more controlled manner. The fingers are usually hollow and each have a discharge opening 13 at the end of the finger (see also FIG. 3). This enables the hairs to be dried close to the roots. As is shown in FIG. 3, the diffuser 8 is formed by a hollow cylindrical housing 14 having a coupling 15 at the rear for attachment to the cylindrical part 2. The coupling 15 bounds an inlet opening 16. The widened front of the housing of the diffuser is closed by the wall portion 10, in which the discharge openings 11 are present. Inside the housing of the diffuser a spider-like body 17 is arranged, which comprises a small central disc 18 secured to the wall portion 10 by means of a pin 19. The pin 19 is secured to the housing 14 by supports 20, which also serve for guiding air. A plurality of arms 21 extend radially outward from the disc 18. The present embodiment has arms 21' and 21" of two different lengths arranged in an alternating fashion. The end of each arm carries a finger 12 so as to form two ring patterns 22 of fingers. The flexibility in the arms, viewed in the direction in which the air flows, is provided by means of a U-shaped hinge 23. Each finger projects from an opening 24 in the wall portion 10. Since there is always a gap 26 between the finger 12 and the edge 25 of the opening 24, this would cause undesired air leakage while also hairs might be caught in the gaps (see FIG. 4). In order to preclude this, the opening 24 around the finger 12 is closed by means of a sealing diaphragm 27. This diaphragm allows adequate movement of the finger in the direction of flow of the air. The movement of the fingers 12 in the diffuser may result in contact between the arms 21 and the wall portion 10. This contact may produce an annoying sound. In order to preclude this, a sound-damping rubber pad 28 is interposed between each arm 21 and the wall portion 10. The sealing diaphragm and the pad can be molded onto the wall portion 10. This can be effected in one process step.

FIGS. 5–9 show a number of examples of how fingers can be configured. As the examples show, the arms carrying the fingers may also be arranged on a ring 29. The ring is secured to the housing of the diffuser. One arm may carry a plurality of fingers. Alternatively, arms may be connected to one another via fingers. There may also be non-flexible fingers.

Figure 10:
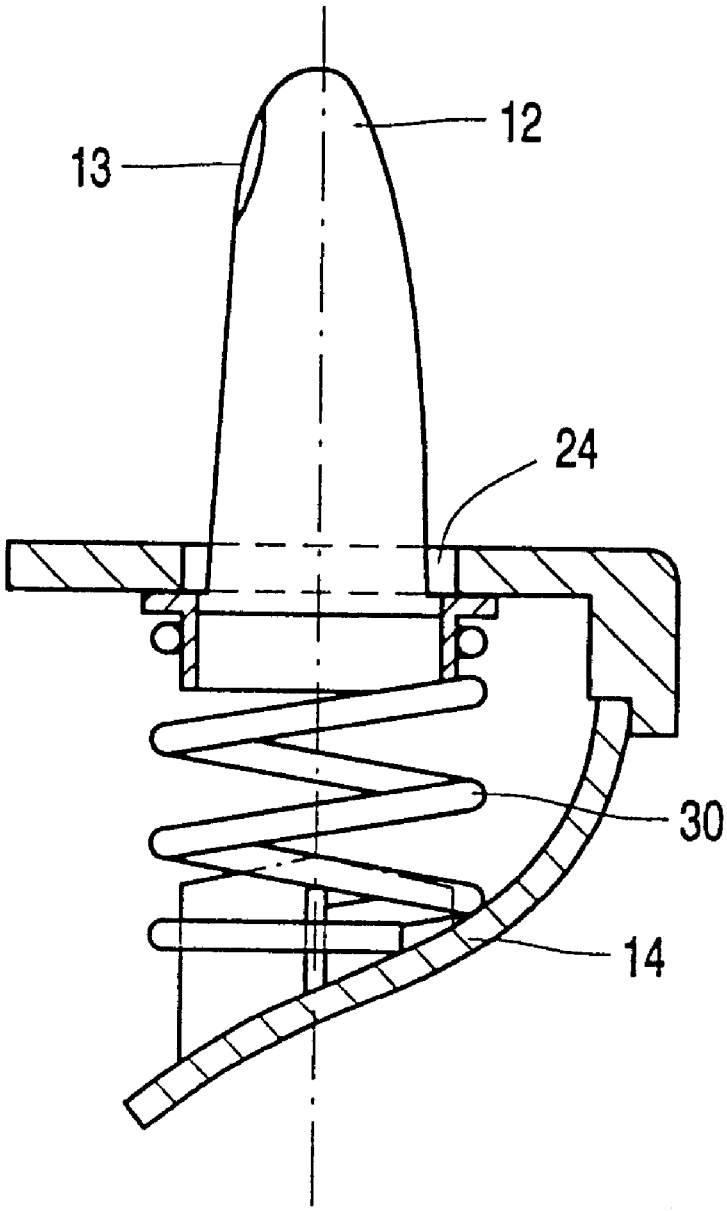
FIG. 10 shows an alternative embodiment.

FIG. 10 shows an alternative embodiment of the invention, in which each finger 12 is arranged on a separate compression spring 30. This is advantageous when there is not enough room in the diffuser 8 for placing resilient arms.

What is claimed is:

1. A hair dryer/styler having a housing which accommodates a motor-fan unit for generating an air stream and having a diffuser for diffusing the emergent air stream and for reducing the velocity of the emergent air stream, which diffuser comprises a plurality of resilient fingers, which extend substantially in the direction of the emergent air stream and which can engage against a scalp during use of the hair dryer/styler, wherein the fingers are carried, individually or in a number of small groups, by a plurality of resilient arms, which are secured to the diffuser.

2. A hair dryer/styler as claimed in claim 1, wherein a wall portion of the diffuser has openings through which the fingers extend.

3. A hair dryer/styler as claimed in claim 1, each resilient arm has a flexible U-shaped hinge.

4. A hair dryer/styler having a housing which accommodates a motor-fan unit for generating an air stream and having a diffuser for diffusing the emergent air stream and for reducing the velocity of the emergent air stream, which diffuser comprises a plurality of resilient fingers, which extend substantially in the direction of the emergent air stream and which can engage against a scalp during use of the hair dryer/styler, wherein the fingers are carried, individually or in a number of small groups, by a plurality of resilient arms which are secured to the diffuser, the resilient arms being arranged on a common central disc of the diffuser.

5. A hair dryer/styler as claimed in claim 4, the resilient arms extend substantially radially outward and have different lengths, the fingers being disposed at the ends of the arms.

6. A hair dryer/styler having a housing which accommodates a motor-fan unit for generating an air stream and having a diffuser for diffusing the emergent air stream and for reducing the velocity of the emergent air stream, w which diffuser comprises a plurality of resilient fingers, which extend substantially in the direction of the emergent air stream and which can engage against a scalp during use of the hair dryer/styler, wherein the fingers are carried, individually or in a number of small groups, by a plurality of resilient means, which are secured to the diffuser, and wherein the wall portion of the diffuser has openings through which the fingers extend, the openings being provided with a sealing diaphragm around the fingers.

7. A hair dryer/styler having a housing which accommodates a motor-fan unit for generating an air stream and having a diffuser for diffusing the emergent air stream and for reducing the velocity of the emergent air stream, which diffuser comprises a plurality of resilient fingers, which extend substantially in the direction of the emergent air stream and which can engage against a scalp during use of the hair dryer/styler, wherein the fingers are carried, individually or in a number of small groups, by a plurality of resilient arms which are secured to the diffuser, the fingers being each arranged on a separate resilient arm.

8. A hair dryer/styler having a housing which accommodates a motor-fan unit for generating an air stream and having a diffuser for diffusing the emergent air stream and for reducing the velocity of the emergent air stream, which diffuser comprises a plurality of resilient fingers, which extend substantially in the direction of the emergent air stream and which can engage against a scalp during use of the hair dryer/styler, wherein the fingers are carried, individually or in a number of small groups, by a plurality of resilient arms which are secured to the diffuser, and wherein the resilient arms are carried by a common ring of the diffuser and each extend substantially radially inward.

9. A hair dryer/styler having a housing which accommodates a motor-fan unit for generating an air stream and having a diffuser for diffusing the emergent air stream and for reducing the velocity of the emergent air stream, which diffuser comprises a plurality of resilient fingers, which extend substantially in the direction of the emergent air stream and which can engage against a scalp during use of the hair dryer/styler, wherein the fingers are carried, individually or in a number of small groups, by a plurality of resilient arms which are secured to the diffuser, and wherein sound-damping means are interposed between a wall portion of the diffuser and the resilient arms.

10. A hair dryer/styler having a housing which accommodates a motor-fan unit for generating an air stream and having a diffuser for diffusing the emergent air stream and for reducing the velocity of the emergent air stream, which diffuser comprises a plurality of resilient fingers, which extend substantially in the direction of the emergent air stream and which can engage against a scalp during use of the hair dryer/styler, wherein the fingers are carried, individually or in a number of small groups, by a plurality of resilient means which are secured to the diffuser, the fingers being each individually arranged on a separate compression spring.

* * * * *